US009134016B2

(12) United States Patent
David et al.

(10) Patent No.: US 9,134,016 B2
(45) Date of Patent: Sep. 15, 2015

(54) ADJUSTABLE LUMINAIRE WITH SLOTTED ARMS

(71) Applicant: Dasal Industries Ltd., Port Coquitlam (CA)

(72) Inventors: Norm David, Port Coquitlam (CA); Russ Jensen, Port Coquitlam (CA); He (Henry) Zhang, Port Coquitlam (CA)

(73) Assignee: DASAL INDUSTRIES LTD., Port Coquitlam (CA)

( * ) Notice: Subject to any disclaimer, the term of this patent is extended or adjusted under 35 U.S.C. 154(b) by 374 days.

(21) Appl. No.: 13/625,388

(22) Filed: Sep. 24, 2012

(65) Prior Publication Data

US 2014/0085912 A1 Mar. 27, 2014

(51) Int. Cl.

| | |
|---|---|
| ***F21S 8/02*** | (2006.01) |
| ***F21V 21/30*** | (2006.01) |
| *F21V 21/04* | (2006.01) |

(52) U.S. Cl.

CPC ..... *F21V 21/30* (2013.01); *F21S 8/026* (2013.01); *F21V 21/04* (2013.01); *F21V 21/043* (2013.01)

(58) Field of Classification Search

CPC ..... F21V 21/26; F21V 1/08; F21V 1/10; F21V 21/03; F21V 21/04; F21V 21/043; F21V 21/047; F21V 21/048; F21V 21/049; F21V 21/30; F21S 8/026

USPC ..... 362/529, 366, 426, 289, 371, 364, 365, 362/40, 39, 419, 530, 285, 277, 427, 428; 248/296.1, 288.51, 274.1, 288.11, 248/291.1; 403/113, 116, 118

See application file for complete search history.

(56) References Cited

U.S. PATENT DOCUMENTS

| | | | | |
|---|---|---|---|---|
| 2,855,503 | A * | 10/1958 | Gerstel | 362/273 |
| 3,387,125 | A * | 6/1968 | Ingolia | 362/529 |
| 3,579,184 | A * | 5/1971 | Forestal | 340/470 |
| 3,601,598 | A * | 8/1971 | Horn | 362/418 |
| 3,609,346 | A * | 9/1971 | Lund et al. | 362/364 |
| 3,987,296 | A * | 10/1976 | Coppola et al. | 362/277 |
| 5,291,381 | A | 3/1994 | Price | |
| 5,562,343 | A | 10/1996 | Chan et al. | |
| 5,738,436 | A | 4/1998 | Cummings et al. | |
| 5,823,664 | A | 10/1998 | Demshki, Jr. et al. | |
| 6,036,337 | A | 3/2000 | Belfer | |
| 6,604,722 | B1 * | 8/2003 | Tan | 248/276.1 |
| 6,764,202 | B1 | 7/2004 | Herring et al. | |

(Continued)

FOREIGN PATENT DOCUMENTS

WO WO2007/030025 A1 3/2007

*Primary Examiner* — Jong-Suk (James) Lee
*Assistant Examiner* — Colin Cattanach
(74) *Attorney, Agent, or Firm* — Cameron IP

(57) ABSTRACT

The present invention relates to a luminaire having a base assembly and a lighting assembly. The luminaire further includes an adjustment arm having a first portion pivotally connecting to a first one of the assemblies. The adjustment arm has a second portion pivotally connecting to and being moveable relative to a second one of the assemblies along a defined path. The adjustment arm has an elongate opening positioned between the first and second portions. The luminaire includes an adjustment member adjustably connected to and selectively moveable from a first position adjacent to the first one of the assemblies to a second position spaced-apart from the first one of the assemblies. The adjustment member operatively connects to and engages with the adjustment arm via the elongate opening of the adjustment arm.

4 Claims, 4 Drawing Sheets

(56) References Cited

U.S. PATENT DOCUMENTS

| | | | | |
|---|---|---|---|---|
| 7,150,541 | B2 | 12/2006 | Burton | |
| 7,431,482 | B1 * | 10/2008 | Morgan et al. | 362/364 |
| 7,517,119 | B2 * | 4/2009 | Kaeser et al. | 362/427 |
| 7,537,189 | B2 * | 5/2009 | Jung et al. | 248/298.1 |
| 7,559,677 | B1 | 7/2009 | Dupre | |
| 7,780,318 | B2 | 8/2010 | Xiao et al. | |
| 8,029,173 | B2 | 10/2011 | Ko | |
| 8,147,107 | B2 * | 4/2012 | Lee et al. | 362/523 |
| 8,215,805 | B2 * | 7/2012 | Cogliano et al. | 362/366 |
| 2003/0007354 | A1 | 1/2003 | Schubert et al. | |
| 2009/0196037 | A1 * | 8/2009 | Xiao et al. | 362/249.03 |
| 2009/0268474 | A1 | 10/2009 | Ward et al. | |
| 2010/0110698 | A1 | 5/2010 | Harwood et al. | |
| 2012/0063152 | A1 * | 3/2012 | Chang | 362/427 |

* cited by examiner

ADJUSTABLE LUMINAIRE WITH SLOTTED ARMS

FIELD OF THE INVENTION

There is provided a luminaire. In particular, there is provided an adjustable luminaire with slotted arms.

DESCRIPTION OF THE RELATED ART

U.S. Pat. No. 7,559,677 to Dupre discloses an adjustment mechanism for a recessed light fixture. The mechanism includes a housing, a first pivoting mechanism connected to the housing, a slotted pivot member connected to the first pivoting mechanism, and an articulating lamp support movably connected to the slotted pivot member for translation and pivoting of the articulating lamp support. The slotted pivot member has two non-parallel slots for moving the articulating lamp support about a variable pivot point.

U.S. Pat. No. 7,780,318 to Xiao et al. discloses an LED flood lamp which includes an LED lamp, a primary bracket and an accessorial bracket. The lamp includes a pair of lateral sidewalls. The primary bracket pivotally connects with the lateral sidewalls. The accessorial bracket has one end pivotally connecting with one lateral sidewall, and another end connected to the primary bracket via a fastener. Each of the primary and accessorial brackets defines an elongated slot. The fastener is slidable along the slots of the primary and accessorial brackets to vary an illumination angle of the lamp. The LED lamp has a substrate, a plurality of LED modules mounted on a top surface of the substrate and a heat sink mounted on a bottom surface of the substrate, whereby heat generated by the LED modules can be transferred to the heat sink via the substrate to be dissipated to ambient air.

BRIEF SUMMARY OF INVENTION

There is provided, and it is an objection to provide, an improved luminaire disclosed herein.

There is accordingly provided a luminaire having a base assembly and a lighting assembly. The luminaire includes an adjustment arm having a first portion pivotally connecting to a first one of the assemblies. The adjustment arm has a second portion pivotally connecting to and being moveable relative to a second one of the assemblies along a defined path. The adjustment arm has an elongate opening positioned between the first and second portions. The luminaire includes an adjustment member adjustably connected to and selectively moveable from a first position adjacent to the first one of the assemblies to a second position spaced-apart from the first one of the assemblies. The adjustment member operatively connects to and engages with the adjustment arm via the elongate opening of the adjustment arm.

There is also provided a luminaire including a light receptacle, a base assembly, an adjustment arm and an adjustment member. The adjustment arm pivotally connects to the light receptacle. The adjustment arm pivotally connects to and is moveable relative to the base assembly along a defined path. The adjustment arm has an elongate opening between the light receptacle and the base assembly. The adjustment member is adjustably connected to the light receptacle. The adjustment member engages with the adjustment arm via the elongate opening.

There is further provided a luminaire having a lighting receptacle and a base assembly. The luminaire further includes a first adjustment arm having a first portion pivotally connecting to the lighting receptacle, a second portion spaced-apart from the first portion and a slot positioned between the first and second portions. The luminaire includes a second adjustment arm having a first portion pivotally connecting to the lighting receptacle. The second adjustment arm has a second portion spaced-apart from its first portion. The second portion of the second adjustment arm connects to the base assembly. The second adjustment arm has a slot positioned between the first and second portions of the second adjustment arm. The second portion of the first adjustment arm pivotally connects to and engages with the second adjustment arm via the slot of the second adjustment arm. The luminaire includes an adjustment member threadably connected to the lighting receptacle. The adjustment member is threadably adjustable from a lower position adjacent to the lighting receptacle to an upper position spaced-apart from the lighting receptacle. The adjustment member pivotally engages with the first adjustment arm via the slot of the first adjustment arm.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figures 1, 2:
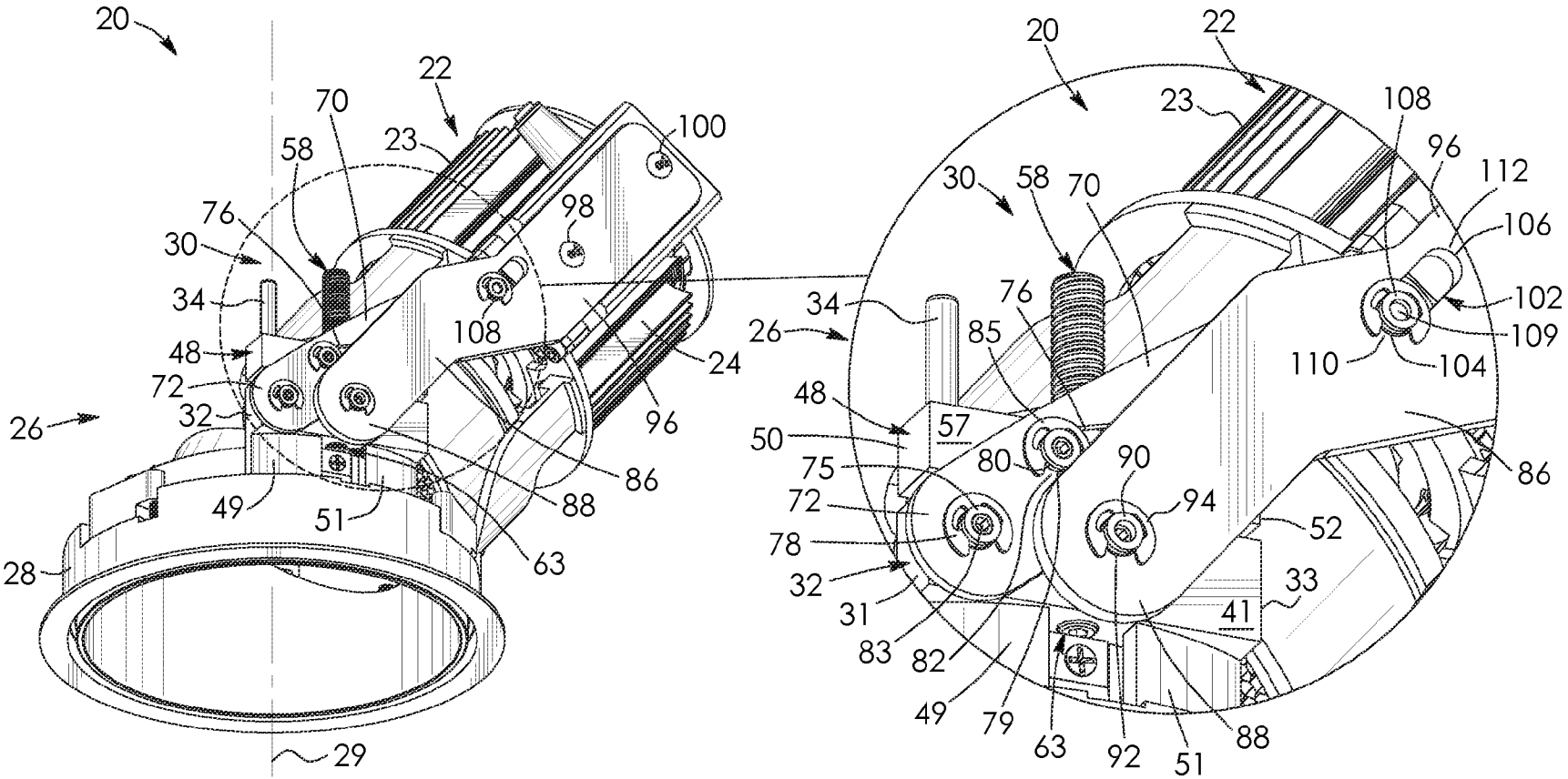
FIG. 1 is a bottom, side perspective view of a luminaire according to one embodiment, the luminaire having a base assembly and a light assembly in a first angular position relative to the base assembly.
FIG. 2 is an enlarged, fragmentary view of part of the luminaire shown in FIG. 1.

Referring to the drawings and first to FIG. 1, there is shown a luminaire 20. The luminaire has a base assembly 22 which in this example includes a fan 23 and a heat sink 24. A conventional off-the-shelf fan well known to those skilled in the art may be used, such as SynJet(trademark) fan.

Referring back to FIG. 1, the luminaire 20 has a lighting assembly 26. The lighting assembly includes a lighting receptacle 28 configured to receive a light bulb. The lighting receptacle is annular in this example and extends around an axis 29.

Figure 4:
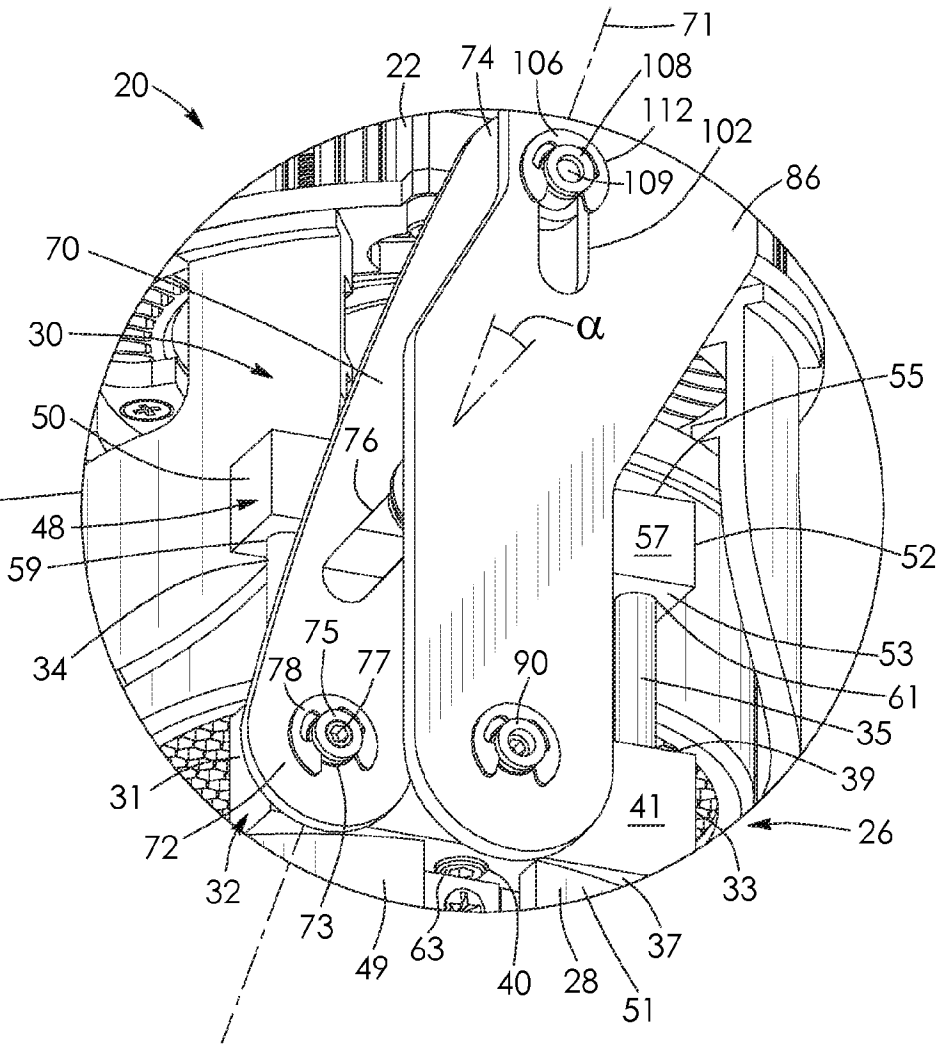
FIG. 4 is an enlarged, fragmentary view of part of the luminaire shown in FIG. 3.

The luminaire 20 has a tilting assembly 30 that connects the base assembly 22 and the lighting assembly 26 together. The tilting assembly includes a base member, in this example a base block 32, connected to and extending axially outwards from the lighting receptacle 28. The base block is in the shape of a rectangular prism in this example. As seen in FIG. 4, the base block 32 has a pair of spaced-apart ends 31 and 33, a bottom 37 extending between its ends and facing the receptacle 28, a top 39 opposite the bottom, and a pair of spaced-apart sides of which side 41 is shown in FIG. 4. Bottom 37, top 39 and sides 41 extend between ends 31 and 33. Sides 41 are positioned perpendicular to bottom 37 and top 39 in this example. Referring to FIG. 4, bottom 37 of block 32 connects to the receptacle 28 via a pair of spaced-apart arcuate shaped members 49 and 51 in this example.

Figure 6:
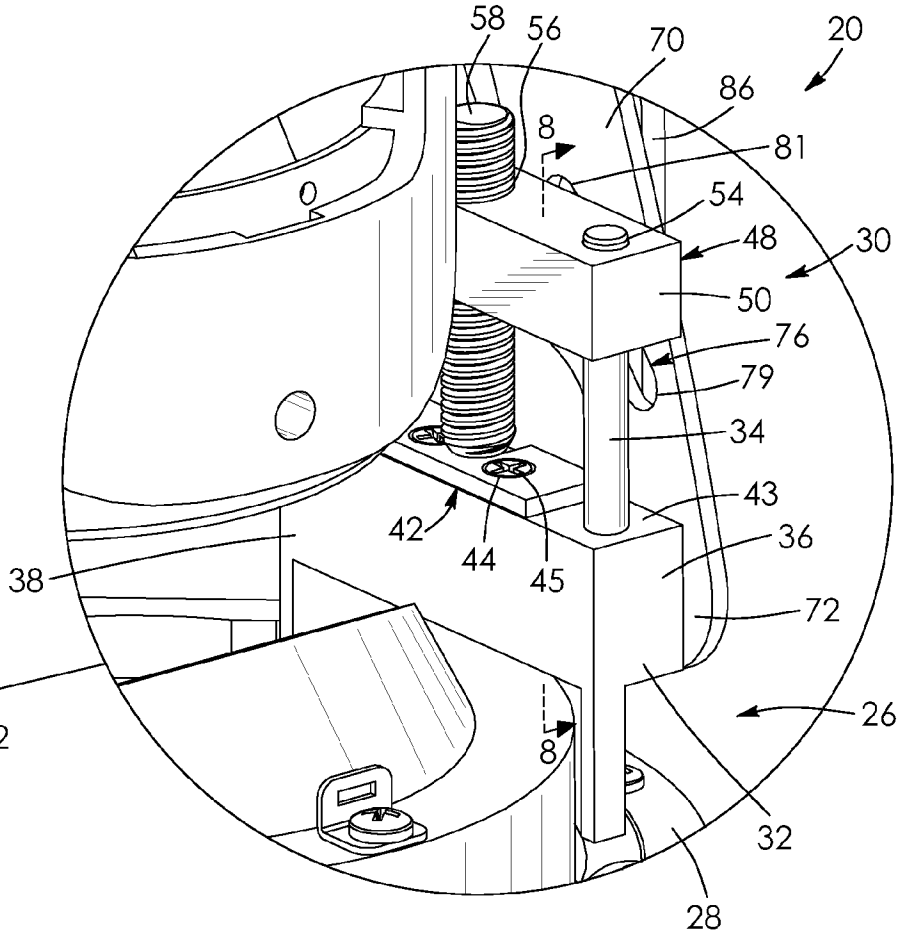
FIG. 6 is an enlarged, fragmentary view of part of the luminaire shown in FIG. 5.
Figure 8:
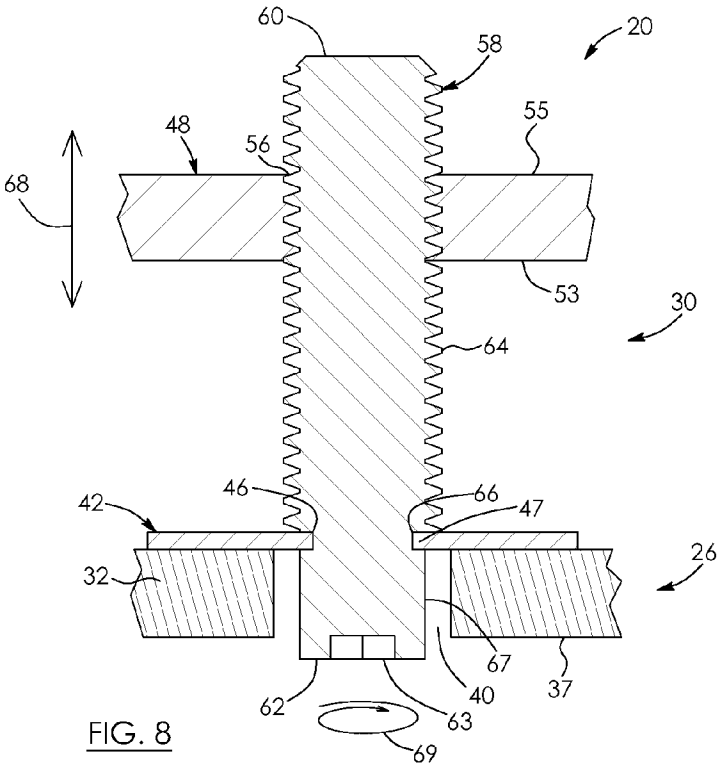
FIG. 8 is a sectional view across lines 8-8 of part of the luminaire of FIG. 6.

As best seen in FIGS. 4 and 6, the tilting assembly 30 includes a pair of spaced-apart elongate members, in this example a pair of shafts 34 and 35, connected to and extending outwards from the spaced-apart ends 31 and 33 of the block 32. The shafts extend axially outwards from receptacle 28. The block 32 includes a central bore 40, positioned between ends 31 and 33, which extends from top 39 to bottom 37. The bore is best seen in FIG. 8.

Figure 5:
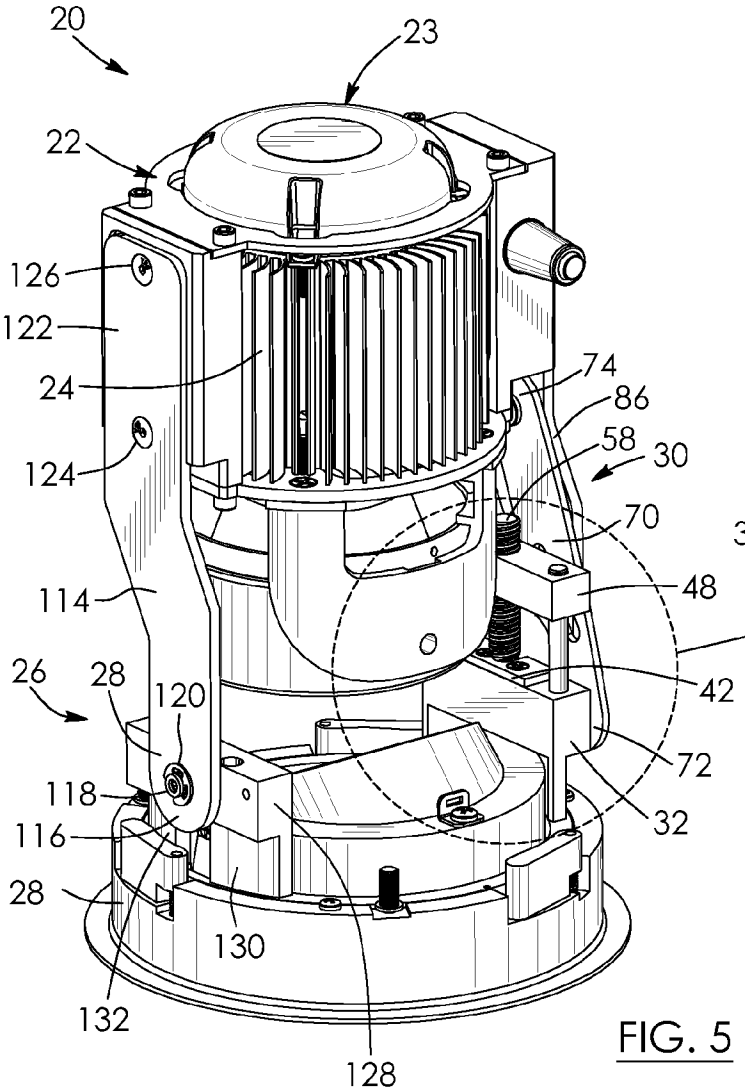
FIG. 5 is a top, side perspective view of the luminaire of FIG. 4.
Figure 7:
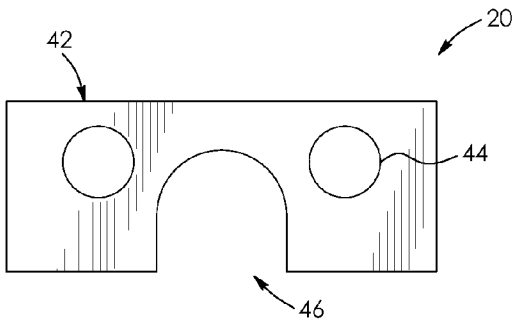
FIG. 7 is a top plan view of a retaining member of the luminaire.

As shown in FIGS. 5 to 7, the tilting assembly 30 has a retaining member 42 connected to the top 39 of block 32. The retaining member has a pair of spaced-apart apertures through which fasteners 44 extend to connect the retaining member to the block, as shown by aperture 44 and fastener 45. The retaining member 42 has an opening, in this example a semi-circular opening 46 as best shown in FIG. 7.

Referring back to FIG. 1, the tilting assembly 30 includes an adjustment member, in this example in the form of an adjustment block 48. The adjustment block is in the shape of a rectangular prism in this example. The adjustment block is adjustably connected to and selectively spaced-apart from block 32.

As seen in FIG. 4, the adjustment block 48 has a pair of spaced-apart ends 50 and 52, with apertures extending through the block adjacent to said ends, as shown by aperture 54 for end 50. Ends 50 and 52 of block 48 align with ends 31 and 33 of block 32 in this example. Block 48 has a bottom 53 facing top 39 of block 32 and extending between ends 50 and 52. Block 48 has a top 55 opposite its bottom. Block 48 also has a pair of spaced-apart sides extending between its ends 50 and 52 and of which side 57 is shown in FIG. 4. Bottom 53, top 55 and sides 57 extend between ends 50 and 52. Sides 57 are positioned perpendicular to bottom 53 and top 55 in this example. Apertures 54 extend from top 55 to bottom 53. The apertures 54 are configured to receive and slidably engage with the shafts 34 and 35 such that the adjustment block 48 is moveable from a first, or lower position best seen in FIGS. 1 and 2, where block 48 is adjacent to block 32 and lighting assembly 26, to a second, or upper position best seen in FIGS. 3 to 6. The adjustment block 48 is spaced-apart from block 32 and lighting assembly 26 in the upper position. The adjustment block is thus moveable relative to the lighting assembly along a defined path and is configured to be selectively, linearly displaceable relative to the shafts 34 and 35.

The adjustment block 48 has a threaded, central bore 56 positioned between its ends 50 and 52, as shown in FIG. 6. As seen in FIG. 8, the bore extends from top 55 to bottom 53. The tilting mechanism 30 is configured so that central bore 56, opening 46 of retaining member 42 and bore 40 of block 32 axially align.

The tilting assembly 30 includes a threaded member or rod 58 for adjusting the adjustment block 48. The threaded rod axially extends outwards from the receptacle 28. The threaded rod 58 threadably connects to the adjustment block 48 via bore 56, as seen in FIG. 8. The threaded rod is positioned between and extends parallel with shafts 34 and 35 in this example, as seen with reference to FIGS. 1 and 4. Referring to FIG. 8, the threaded rod 58 has a first end 60, a second end 62 spaced-apart from the first end, a threaded portion 64 extending from the first end towards to the second end, an annular groove 66 positioned between the threaded portion and the second end, and a non-threaded portion 67, in this example, between the groove and second end. The threaded rod includes a socket head, in this example a hexagonal socket head 63 that may be engaged with a tool such as an Allen key, in this example, to selectively rotate the threaded rod 58, as shown by arrow 69 in FIG. 8.

The threaded rod 58 is configured to extend through bore 56, opening 46 of retaining member 42 and bore 40 of block 32. Bore 40 is larger in diameter compared to intermediate portion 67 which is adjacent thereto. Groove 66 receives the threaded rod 58. Opening 46 of retaining member 42 is configured to rotatably receive the threaded rod 58 to permit rotation of the threaded rod. Portions 47 of the retaining member adjacent groove 66 are configured to inhibit axial movement of the threaded rod 58 relative to block 32. Socket head 63 extends past block 32 and bore 40, and is positioned in this example adjacent to bottom 37 of block 32, as seen in FIG. 4, so as to be accessible to a user. Thus, the threaded rod 58 is rotatable via socket head 63 to selectively lower and raise the adjustment block 48, as shown by arrow 68 in FIG. 8, from its lower position shown in FIGS. 1 to 2 to its upper position shown in FIGS. 2 to 6.

Referring back to FIG. 1, the tilting assembly 30 includes a first adjustment arm 70. The arm has a flat, elongated shape in this example. The arm 70 has a first portion 72 pivotally connecting to block 32 and thus the lighting assembly 26. As seen in FIG. 4, arm 70 has an aperture 73 located adjacent to portion 72 in this example. An elongate connector, in this example a fastener 75, extends through aperture 73. The fastener is a bolt in this example. The aperture is sized to enable free rotation of the arm 70 about the fastener, the first portion 72 of the arm thus being rotatable about an axis 83 that is fixed relative to the arm as seen in FIG. 2. The fastener 75 threadably connects to side 41 of block 32 adjacent to end 31 of the block. The fastener has a socket head 77 for engaging a tool such as an Allen key (not shown). The assembly 30 includes a c-clip 78 configured to connect with the fastener 75. Arm 70 is positioned between side 41 of block 32 and the c-clip. The c-clip 78 and fastener 75 are configured to pivotally hold in place arm 70 so that the arm slidably abuts side 41 of block 32.

Figure 3:
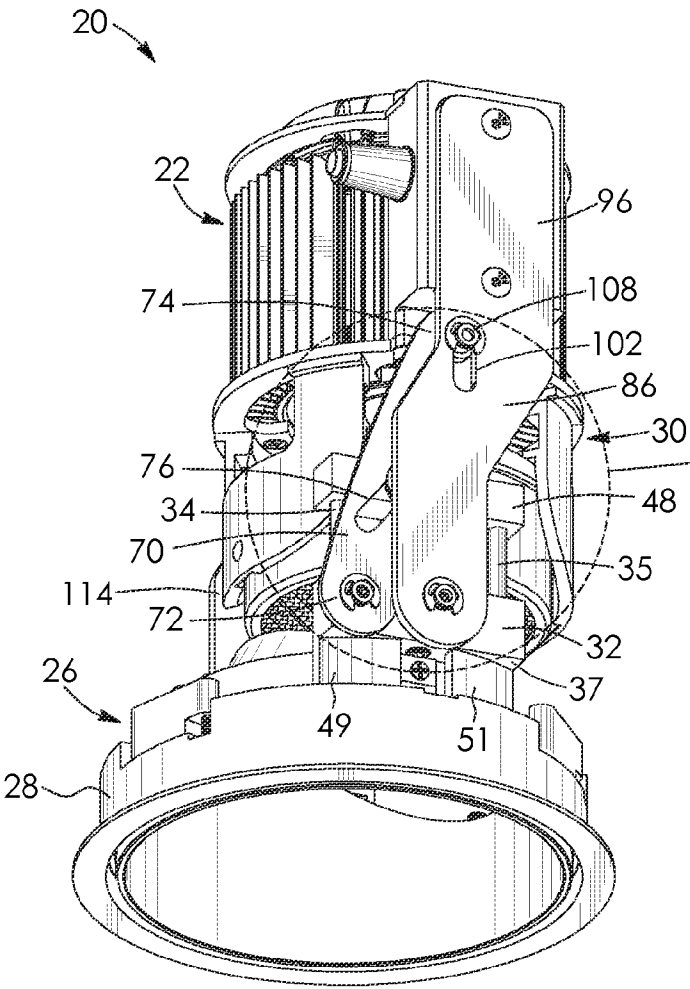
FIG. 3 is a bottom, side perspective view of the luminaire of FIG. 1, the light assembly being shown in a second angular position relative to the base assembly.

The first adjustment arm 70 has a second portion 74, best seen in FIGS. 3 to 5, spaced-apart from portion 72. The arm has a longitudinal axis 71 extending between portions 72 and 74, as seen in FIG. 4, and an elongate opening, in this example a slot 76. The slot is positioned between first portion 72 and second portion 74 in this example and is thus positioned between the light receptacle 28 and the base assembly 22. The slot 76 extends linearly and is angled relative to the longitudinal axis 71 by an angle $\alpha$. As seen in FIG. 6, the slot has a first end 79 positioned adjacent to portion 72 of arm 70, extends towards portion 74 of the arm, and has a second end 81 spaced-apart from end 79.

As seen in FIGS. 1 and 2, the adjustment block 48 pivotally connects to and engages with the adjustment arm 70 via the slot 76. As best seen in FIG. 2, the assembly 30 has an elongate connector, in this example fastener 80 that extends through slot 76 and threadably connects to side 57 of adjustment block 48 at a location between ends 50 and 52 of the block. Fastener 80 may be referred to as a protrusion extending outwards from the adjustment block 48. The slot 76 is sized to slidably receive the fastener 80 and provides a defined, linear path to permit the fastener to move therealong. As adjustment block 48 moves from its lower position shown in FIGS. 1 and 2 to its upper position shown in FIGS. 3 to 6, fastener 80 moves from a first position in which it abuts portions 82 of the arm 70 adjacent to end 79 as seen in FIG. 2, to a second position in which it abuts portions 84 of the arm adjacent to end 81 of the slot as seen in FIG. 6. Referring back to FIG. 2, assembly 30 also includes a c-clip 85 that connects to fastener 80 in a like manner as c-clip 78 to retain arm 70 against side 57 of block 48 while enabling the arm to be rotatable relative to and about fastener 80.

Referring back to FIG. 1, the tilting assembly 30 has a second adjustment arm 86 having a flat, elongated z-shape in this example. The arm has a first portion 88 pivotally connecting to block 32 and thus to the lighting receptacle 28. As seen in FIG. 2, portion 88 pivotally connects to block 32 via a fastener 90 that extends through an aperture 92 of the arm 86 located adjacent to portion 88. Fastener 90 threadably connects to side 41 of the block at a location between ends 31 and 33. The fastener is configured to ensure that arm 86 is adjacent to and is spaced-apart from arm 70, fastener 82 and clip 85 so that arm 86 may slide and angularly rotate relative thereto. Aperture 92 and fastener 90 are sized to permit free rotation of arm 86 about fastener 90. C-clip 94 engages fastener 90 and retains arm 86 adjacent to side 41 of block 32 as before for holding arm 86 in place.

Referring to FIG. 1, the second adjustment arm 86 has a second portion 96 spaced-apart from the first portion 88. The second portion of the arm connects to the base assembly 22 in this example via fasteners 98 and 100 as seen in FIG. 1. The second portion 96 may be referred to as part of the base assembly 22. As seen in FIG. 4, slot 76 of adjustment arm 70 is angled towards the second adjustment arm by angle $\alpha$ that is equal to 22.5 degrees in this example relative to axis 71. As best seen in FIG. 2, the second adjustment arm 86 has an elongate opening, in this example a slot 102 positioned adjacent to portion 96 and base assembly 22 in this example. The slot has a first end 104 and a second end 106 spaced-apart from the first end.

As shown in FIG. 3, the second portion 74 of the first adjustment arm 70 pivotally connects to and engages with the second adjustment arm 86 via an elongate connector, in this example a fastener 108 and slot 102 of the second adjustment arm. Referring to FIG. 4, fastener 108 has an axis 109 and connects to and extends outwards from arm 70 in this example, axis 109 thus being fixed relative to arm 70. Fastener 108 extends through, engages with, and is thus slidable moveable along slot 102. As seen in FIG. 2 and 4, second portion 74 of arm 70 is rotatable about axis 109 of the fastener 108. Slot 102 and fastener 108 are configured to allow the fastener to move from a first position shown in FIG. 2 in which the fastener abuts portions 110 of arm 86 adjacent to end 104 of slot 102, to a second position seen in FIG. 4 in which the fastener abuts portions 112 of the arm adjacent to end 106 of the slot. When the adjustment block 48 is in the lower position shown in FIGS. 1 and 2, the fastener 108 is in its first position and when the adjustment block is in its upper position shown in FIGS. 3 to 6, the fastener is in its second position.

Referring to FIG. 5, the tilting assembly 30 includes another adjustment arm 114 in this example. Arm 114 has a flat, elongated z-shape in this example, and is spaced-apart by 180 degrees about receptacle 128 and axis 29, relative to arms 70 and 86 in this example. The arm has a first portion 116 that pivotally connects to the lighting receptacle 28 via an elongate connector, in this example a fastener 118. A c-clip 120 holds arm 114 in place. Fastener 118 and c-clip 120 are substantially similar in parts as function as fastener 75 and c-clip 78 for arm 70 seen in FIG. 2, and therefore will not be described further. Arm 114 has a second portion 122 spaced-apart from portion 116. The second portion of arm 114 connects to the base assembly 22 via fasteners 124 and 126 in this example. Assembly 30 has a further base member, in this example a further base block 128, which is substantially similar to block 32 and to which arm 114 is pivotally mounted. The assembly has a further pair of arcuate members 130 and 132 substantially similar to members 49 and 51 and which connect to receptacle 28. Block 128 connects to the tops of and is integral with members 130 and 132.

In operation and referring first to FIG. 2, rotation of the threaded rod 58 via socket head 63 causes the adjustment block 48 to move upwards. This causes fastener 80 to engage and rotate arm 70 while moving from its first position seen in FIGS. 1 to 2 to its second position along slot 76 seen in FIGS. 3 to 6. Angular movement of arm 70 causes fastener 108 to engage and rotate arm 86 while the fastener 108 moves from its first position seen in FIGS. 1 to 2 to its second position seen in FIGS. 3 to 6. As arm 86 rotates, so too does lighting assembly 26 rotate relative to base assembly 22. The tilting assembly 30 thus enables angular displacement of the lighting receptacle 28 relative to the base assembly. The threaded rod 58 is therefore configured to selectively raise and lower the adjustment block 48 for adjusting angular positioning of the lighting assembly 26 relative to the base assembly 22.

It will be appreciated that many variations are possible within the scope of the invention described herein. For example, there are many other ways in which pivotal connects may be arranged for connecting together the arms 70 and 86 and adjustment block 48. While slots 76 and 102 are described herein, other types of elongate opening may be provided in other embodiments.

It will be understood by someone skilled in the art that many of the details provided above are by way of example only and are not intended to limit the scope of the invention which is to be determined with reference to at least the following claims.

What is claimed is:

1. A luminaire comprising:

an elongate connector;

a lighting receptacle;

a base assembly;

a first adjustment arm having a first portion pivotally connecting to the lighting receptacle, the first portion being rotatable about an axis that is fixed relative to the adjustment arm, the first adjustment arm having a second portion spaced-apart from the first portion, the second portion being rotatable about an axis of the elongate connector, the axis of the elongate connector being fixed relative to the adjustment arm, the elongate connector being slidably moveable relative to the base assembly along a defined path, and the first adjustment arm having a slot positioned between the first and second portions;

a second adjustment arm having a first portion pivotally connecting to the lighting receptacle, a second portion spaced-apart from the first portion of the second adjustment arm, the second portion of the second adjustment arm connecting to the base assembly, and a slot positioned between the first and second portions of the second adjustment arm, the second portion of the first adjustment arm pivotally connecting to and engaging with the second adjustment arm via the elongate connector which is slidably moveable within the slot of the second adjustment arm; and an adjustment member threadably connected to the lighting receptacle, the adjustment member being threadably adjustable from a lower position adjacent to the lighting receptacle to an upper position spaced-apart from the lighting receptacle, the adjustment member pivotally engaging with the first adjustment arm via the slot of the first adjustment arm.

2. The luminaire as claimed in claim 1 wherein threaded adjustment of the adjustment member causes the adjustment member to engage and rotate the first adjustment arm, which causes the first adjustment arm to engage and rotate the second adjustment arm, which causes angular displacement of the lighting receptacle relative to the base assembly.

3. The luminaire as claimed in claim 1 further including a threaded member threadably connected to the adjustment member for selectively adjusting the adjustment member and further including a retaining member connected to the lighting receptacle, the retaining member engaging a groove of the threaded member so as to permit rotation of the threaded member and inhibit axial movement of the threaded member.

4. The luminaire as claimed in claim 1, further including second and third elongate connectors for pivotally connecting the first portions of the adjustment arms to the lighting receptacle, a fourth elongate connector connected to the adjustment member, the fourth elongate connector extending through the slot of the first adjustment arm, and a plurality of c-clips configured to extend around the elongate connectors so as to hold the adjustment arms in place while permitting angular movement of the adjustment arms.

* * * * *